US008926168B2

(12) United States Patent
Cattin et al.

(10) Patent No.: US 8,926,168 B2
(45) Date of Patent: Jan. 6, 2015

(54) ECONOMICAL TIMEPIECE BARREL

(71) Applicant: ETA SA Manufacture Horlogere Suisse, Grenchen (CH)

(72) Inventors: Christophe Cattin, Delemont (CH); Raphael Loeffel, Le Landeron (CA); Gael Feusier, Moutier (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 111 days.

(21) Appl. No.: 13/775,599

(22) Filed: Feb. 25, 2013

(65) Prior Publication Data

US 2013/0223194 A1 Aug. 29, 2013

(30) Foreign Application Priority Data

Feb. 29, 2012 (EP) ..... 12157575

(51) Int. Cl.
*G04B 1/10* (2006.01)
*G04B 33/14* (2006.01)
*G04B 1/16* (2006.01)

(52) U.S. Cl.
CPC . *G04B 1/16* (2013.01); *G04B 33/14* (2013.01)
USPC ..... 368/143; 368/203

(58) Field of Classification Search
USPC ..... 368/140–144, 220, 203; 29/432
See application file for complete search history.

(56) References Cited

U.S. PATENT DOCUMENTS

| | | | | |
|---|---|---|---|---|
| 202,795 | A * | 4/1878 | Davies | 368/153 |
| 223,673 | A * | 1/1880 | Hotchkiss | 368/124 |
| 389,852 | A | 9/1888 | Moulton et al. | |
| 1,339,941 | A * | 5/1920 | Borresen | 368/142 |
| 1,392,676 | A * | 10/1921 | Borresen | 368/142 |
| 1,643,403 | A * | 9/1927 | Borresen | 368/144 |
| 7,452,123 | B2 * | 11/2008 | Girardin | 368/140 |

FOREIGN PATENT DOCUMENTS

| | | |
|---|---|---|
| CH | 91614 | 11/1921 |
| CH | 158295 | 11/1932 |
| CH | 212244 | 11/1940 |
| CH | 231733 | 4/1944 |
| DE | 1 872 388 | 5/1963 |
| FR | 456.971 | 9/1913 |
| FR | 1.042.548 | 11/1953 |

OTHER PUBLICATIONS

European Search Report issued Sep. 21, 2012, in Patent Application No. EP 12 15 7575, filed Feb. 29, 2012 (With English-language Translation).

* cited by examiner

*Primary Examiner* — Sean Kayes

(74) *Attorney, Agent, or Firm* — Oblon, Spivak, McClelland, Maier & Neustadt, L.L.P.

(57) ABSTRACT

Timepiece barrel with a drum coaxial to a barrel arbour in a direction arranged to confine a barrel spring hooked to the drum and to a core coaxial to the barrel arbour and guided thereon. The core pivots in a bore of the drum, and includes a first stopping surface limiting the axial travel of the core, in the direction, relative to an inner face of the drum, and a second stopping surface opposite the first and limiting the axial travel of the core, relative to an outer face of the drum, which is arranged, on the one hand, imprisoned between the first stopping surface and the second stopping surface, and on the other hand to pivot freely about the core.

19 Claims, 2 Drawing Sheets

ECONOMICAL TIMEPIECE BARREL

This application claims priority from European Patent Application No. 12157575.7 filed Feb. 29, 2012, the entire disclosure of which is incorporated herein by reference.

FIELD OF THE INVENTION

The invention concerns a timepiece barrel including a pivoting drum comprising a toothing, coaxial to a barrel arbour in a direction of pivoting, said drum being arranged to confine at least one barrel spring, a first end of which is fixed or hooked to said drum, and a second end of which is fixed or hooked to a core, which is coaxial to said barrel arbour and guided on said barrel arbour.

The invention concerns a timepiece movement incorporating at least one barrel of this type.

The invention concerns a timepiece including a timepiece movement of this type and/or at least one barrel of this type.

The invention concerns the field of horology, and more specifically the field of energy storage using a barrel with a barrel spring for a drive movement or striking work movement.

BACKGROUND OF THE INVENTION

Conventionally, a going barrel for a timepiece movement includes a drum, in which a barrel spring is assembled, wound around a barrel arbour. This barrel spring, generally spiral-shaped, is hooked or fixed to a first peripheral end inside said drum. It is hooked or fixed to a second central end, either to said barrel arbour, or to a core which is coaxial to said barrel arbour, and at least partially guided thereon.

The barrel pivots relative to a bottom plate or barrel bar, on the barrel arbour or the core, in jewels or guide members of the bottom plate or bar.

The barrel is closed, to confine the spring, either by a cover fixed to the drum by clips or other means, or by a ratchet, which is rotatably integral with the barrel arbour or the core depending on the particular case, and thus also forms a cover.

Few configurations permit both automated assembly and easy removal of the barrel from the movement during a maintenance operation.

In the first case where the cover is fixed to the drum and independent of the ratchet, it is impractical to secure the ratchet, generally using screws, in an automated manner. If it is necessary to remove the barrel, for example in the event that the spring breaks, the timepiece movement incorporating the barrel has to be largely dismantled.

In the second case, where the ratchet alone closes the barrel, it is only the barrel spring itself that securely holds the barrel, which is insufficient to permit automated assembly of the whole unit. When, in this configuration, the second central end of the spring is hooked or fixed to a core which pivots about a fixed arbour integral with the bottom plate and/or barrel bar, it is possible to remove the barrel by dismantling fewer components of the movement than in the preceding case where the cover is fixed to the drum and independent of the ratchet.

In both the first and second case, under the effect of accelerations and particular in the event of a shock, the barrel is liable to move away from its pivoting points, and no longer be able to perform the function of driving the movement to which it is dedicated.

DE Utility Model 18 72 388 U in the name of EPPLE KG OTERO UHREN discloses a barrel with an internally threaded socket pivoting in a bar and carrying a ratchet pivoting integrally therewith. This socket includes an external groove which cooperates with a strip spring fixed to said bar and abutting on the bottom plate. The internal threading of the socket acts as a housing for a barrel arbour which includes: a bottom shoulder pivoting in the bottom plate, a median cylindrical shoulder pivoting in a core which abuts on the socket, a thread cooperating with the internal threading of the socket, and a top head which holds the ratchet on the socket. The core has two shoulders, one acting as a support for the drum and the other for the cover. A first core limiting surface, which is the surface abutting on the drum, and a second core stopping surface, which is the surface abutting on the socket, form a limit in the same direction of movement of the core.

CH Patent Application No. 158 295 A in the name of AMIDA discloses a barrel with a drum including external hooking lugs limiting the expansion of the spring. The drum is pressed onto a ring, and a minute wheel and a small wheel can slide onto a shoulder of the ring, in which the barrel arbour pivots, limited by a circlip. The arbour is limited in this case by two opposite stop members: the circlip, and the top shoulder whose diameter is larger than the arbour, on either side of the ring. The drum, integral with the ring, is imprisoned between the two stopping surfaces of the core.

U.S. patent application Ser. No. 389,852 A in the name of MOULTON discloses a barrel for a clock, without a drum, but with a fixed frame which includes a fixed hooking point for the outer end of the spring.

FR Patent Application No 1 042 548 A in the name of PARRENIN LANGE discloses a removable barrel, rotatably mounted about a hollow arbour which contains a removable pin, which pivots integrally therewith but is free to move in translation, said pin including a means of driving the ratchet.

SUMMARY OF THE INVENTION

The invention proposes to devise a barrel whose assembly can easily be automated, particularly with a simplified method of securing the ratchet, and whose components are integral with each other so that the barrel forms an autonomous sub-assembly ready to be mounted in a higher order assembly, in particular a movement. It is also an object of the invention to allow the barrel to be easily extracted relative to the movement or to the assembly in which it is assembled.

The invention therefore concerns a timepiece barrel including a pivoting drum comprising a toothing, coaxial to a barrel arbour in a direction of pivoting, said drum being arranged to confine at least one barrel spring, a first end of which is fixed or hooked to said drum and a second end of which is fixed or hooked to a core, which is coaxial to said barrel arbour and guided on said barrel arbour, characterized in that said core is pivotally guided in a bore comprised in said drum, and includes a first core limiting surface arranged to limit the axial travel of said core, in said pivoting direction, relative to an inner surface of said drum, and a second core stopping surface opposite said first core limiting surface and arranged to limit the axial travel of said core, in said pivoting direction, relative to an outer surface of said drum. Said drum is arranged, on the one hand, imprisoned between said first core limiting surface and said second core stopping surface, which are in opposition to each other, and on the other hand, to pivot freely about said core.

According to a feature of the invention, said first core limiting surface and/or said second core stopping surface is formed by a rivet seam which projects radially relative to said bore of said drum.

According to a feature of the invention, said first core limiting surface and/or said second core stopping surface is formed by a component, which is coaxial to said core, driven onto or fixed to said core and projects radially relative to said bore of said drum.

According to a feature of the invention, said barrel arbour is removable and includes a shoulder which is arranged to cooperate in guidance, in a bore of said core, and further includes a first arbour stopping surface and a second arbour stopping surface which are opposite each other and arranged to limit together the axial travel, in said pivoting direction, of said barrel arbour relative to a structure for receiving said barrel.

According to a feature of the invention, at least said first arbour stopping surface or said second arbour stopping surface is made in a single-piece with said arbour in the form of a collar which projects radially relative to said shoulder.

According to a feature of the invention, at least said first arbour stopping surface or said second arbour stopping surface is made on a component that can be removed from said arbour.

According to a feature of the invention, at least said first arbour stopping surface or said second arbour stopping surface is formed by a circlip or a key cooperating with a groove or a housing comprised in said arbour.

According to a feature of the invention, said core includes a means of axial supporting and centring a ratchet, and a means of pivotally driving said ratchet.

According to a feature of the invention, said means of pivotally driving said ratchet include at least one flat driving portion.

According to a feature of the invention, said ratchet is driven onto or fixed to said core.

According to a feature of the invention, said ratchet includes a means of spacing with respect to an internal surface of a structure for receiving said barrel.

According to a feature of the invention, said barrel is a going barrel or a striking work barrel.

The invention concerns a timepiece movement incorporating at least one barrel of this type, characterized in that said movement includes a structure with at least one first wall and one second wall together defining a chamber for receiving said barrel, and each including a bore coaxial to the other for receiving and pivotally guiding said barrel arbour, said first wall including a first complementary arbour stopping surface arranged to form an axial travel limit for said first arbour stopping surface, and said second wall including a second complementary arbour stopping surface to form an axial travel limit for said second arbour stopping surface, to limit, together, the axial travel of said arbour relative to said structure in said pivoting direction.

According to a feature of the invention, opposite said first complementary arbour stopping surface, said first wall includes a first inner axial travel limiting surface for limiting the axial travel of said core and/or said drum relative to said structure in said pivoting direction.

According to a feature of the invention, opposite said second complementary arbour stopping surface, said second wall includes a second inner axial travel limiting surface for limiting the axial travel of said core and/or said ratchet relative to said structure in said pivoting direction.

According to a feature of the invention, said second inner axial travel limiting surface includes a means of spacing with respect to said ratchet.

The invention concerns a timepiece including a timepiece movement of this type and/or at least one barrel of this type.

The invention also concerns a method of assembling a timepiece barrel in a receiving structure, characterized in that the following are used:

one said barrel including:

a drum coaxial to a barrel arbour in a pivoting direction, said drum being arranged to confine at least one barrel spring, a first end of which is fixed or hooked to said drum and a second end of which is fixed or hooked to a core, which is coaxial to said barrel arbour and guided on said barrel arbour, said barrel arbour being removable and including a shoulder arranged to cooperate with a bore of said core and further including a first arbour stopping surface and a second arbour stopping surface, which face each other and are arranged to limit together the axial travel of said barrel arbour relative to said structure in said pivoting direction, said core being pivotally guided in a bore comprised in said drum, and including a first core limiting surface, which is arranged to limit the axial travel, in said pivoting direction, of said core relative to an inner face of said drum, and a second core stopping surface, which is opposite said first core limiting surface and arranged to limit the axial travel, in said pivoting direction, of said core relative to an outer face of said drum, and said core including a means of axially supporting and centring a ratchet, and a means of pivotally driving said ratchet, one said structure including at least one first wall and one second wall together delimiting a chamber for receiving said barrel, and said first wall and said second wall each including a bore, coaxial to the other, for receiving and pivotally guiding said barrel arbour, said first wall including a first complementary arbour stopping surface to form an axial travel limit for said first arbour stopping surface, and said second wall including a complementary arbour stopping surface to form an axial travel limit for said second arbour stopping surface, to limit together the axial travel, in said pivoting direction, of said arbour relative to said structure, further characterized in that the following steps are performed in succession:

said core is inserted into said drum so that said drum is arranged, on the one hand, imprisoned between said first core limiting surface and said second core stopping surface, and on the other hand to pivot freely about said core, by immobilising said first core surface and said second core surface relative to said core;

said at least one barrel spring is inserted into said drum, and said first end is fixed or hooked to said drum, and said second end is fixed or hooked to said core;

a ratchet is immobilised on said axial supporting and centring means and said means of pivotally driving said ratchet comprised in said core;

said sub-assembly formed by said barrel drum, said barrel spring, said core and said ratchet is inserted between said first wall and said second wall of said structure, and said bore of said core is positioned in alignment with said coaxial bores of said structure;

said barrel arbour is passed from one of the sides of said structure, through one of said walls of said structure, then through the other of said walls of said structure, said barrel arbour is then immobilised by fixing said first arbour stopping surface and said second arbour stopping surface thereto.

The invention permits a substantial reduction in production and assembly costs, simplifies the barrel assembly, and also simplifies the components thereof. The invention enables components to be joined to each other in sub-assembly stages, simplifying assembly operations which can easily be automated, with a paraxial manipulator in the direction of pivoting, which further reduces costs already improved by the simplification of components and the consequent reduction in the unit cost thereof. The barrel remains removable once the movement has been completely assembled. Finally, shock resistance is improved by locking the barrel arbour, which passes through the walls of the structure and which is rigidly stopped by the first and second arbour stopping surfaces.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
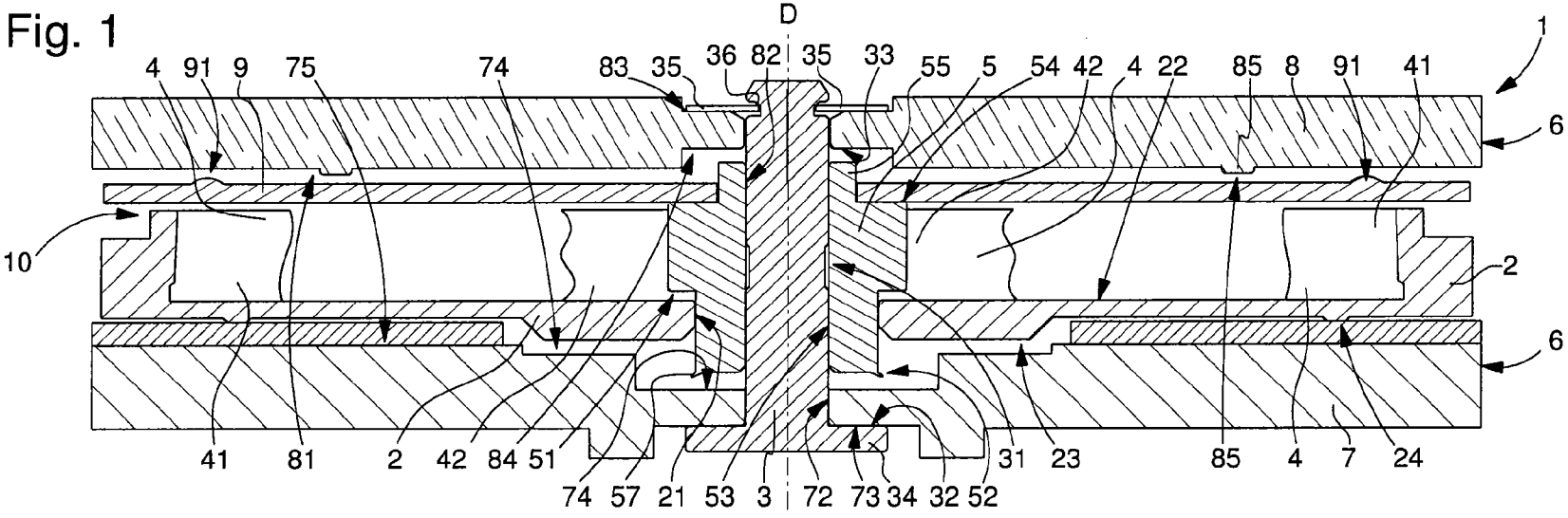
FIG. 1 shows a schematic cross-section of a barrel according to the invention in a plane passing through the pivot axis thereof.

The invention concerns the field of horology, and more specifically the field of energy storage using a barrel with a barrel spring for a drive movement or striking work movement.

The invention concerns a timepiece barrel 1, mounted between a bottom plate 7 and a bar 6 and including a drum 2 coaxial to a barrel arbour 3 in a direction of pivoting D.

This drum 2 is arranged to confine at least one barrel spring 4 a first end 41 of which is fixed or hooked to said drum 2, or cooperates with the drum 2 where spring 4 is adherently mounted with a sliding bridle, and a second end 42 of which is fixed or hooked to a core 5, which is coaxial to said barrel arbour 3 and guided on barrel arbour 3, on a hook 43 or similar.

Core 5 is pivotally guided in a bore 21 comprised in drum 2 and includes a first core limiting surface 51, arranged to limit the axial travel, in pivoting direction D, of core 5 relative to an inner surface 22 of drum 2, and a second core stopping surface 52 opposite the first core limiting surface 51 and arranged to limit the axial travel, in pivoting direction D, of core 5 relative to an outer face 23 of drum 2. This second core stopping surface 52 is arranged to cooperate with a surface of a structure carrying barrel arbour 3, in particular with a top surface 74 of a bottom plate 7.

Preferably, there is a space between the first limiting surface 51 and inner face 22, so that efficiency is not decreased by friction.

Drum 2 is arranged, on the one hand, imprisoned between the first core limiting surface 51 and the second core stopping surface 52 and on the other hand, to pivot freely about core 5. Said surfaces 51 and 52 are in opposition to each other.

Figure 2:
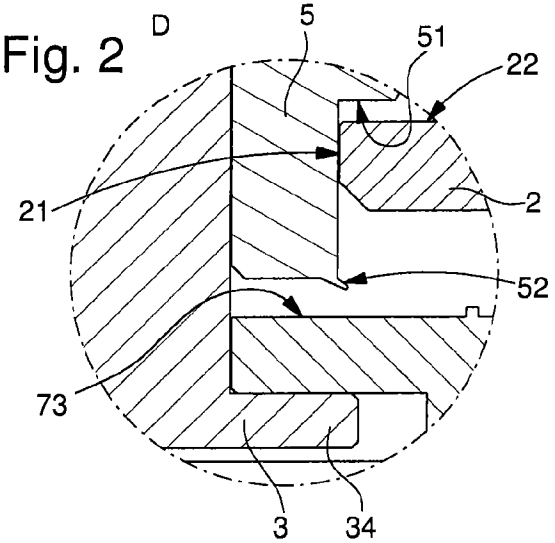
FIG. 2 shows a detail of FIG. 1, showing the core of the barrel in a particular variant embodiment.
Figure 5:
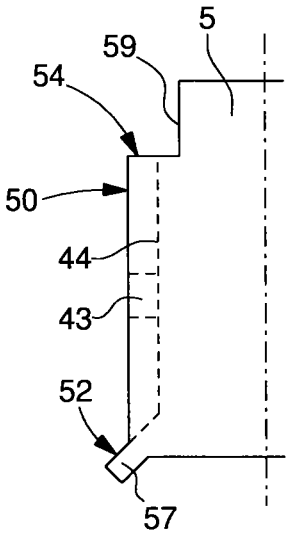
FIGS. 5 and 6 show schematic elevations of particular core variants.
Figure 6:
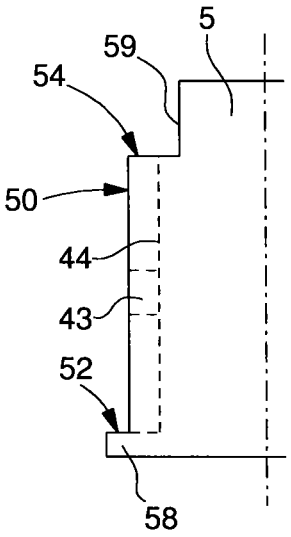

In an advantageous embodiment visible in FIGS. 1, 2 and 5, the first core limiting surface 51 and/or the second core stopping surface 52 is formed by a rivet seam 57 which projects radially relative to said bore 21 of drum 2. In the variant of FIG. 6, the second core stopping surface 52 is formed by a collar 58.

In another variant, the first core limiting surface 51 and/or the second core stopping surface 52 is formed by a component which is coaxial to core 5, driven into or fixed to core 5 and projects radially relative to said bore 21 of drum 2, such as a ring or similar element. FIGS. 5 and 6 illustrate cores 5 including an outer guide surface 50, only the second core stopping surface 52 projects radially relative to said outer guide surface 50, onto which a ring or similar element, forming the first limiting surface 51, can easily be driven. Core 5 then includes, set back from surface 50, a hook 43 for hooking barrel spring 4 and a recess 44 around said hook 43.

Preferably and advantageously, barrel arbour 3 is removable and includes a shoulder 31 arranged to cooperate in guidance in a bore 53 of core 5. This arbour 3 further includes a first arbour stopping surface 32 and a second arbour stopping surface 33, which face each other and are arranged to limit together the axial travel, in pivoting direction D, of barrel arbour 3 relative to a structure 6 for receiving the barrel.

In a first embodiment, as seen in FIGS. 1 and 2, at least the first arbour stopping surface 32 or the second arbour stopping surface 33 is made in a single-piece with barrel arbour 3, in the form of a collar 34 projecting radially relative to shoulder 31. In FIG. 1, this collar 4, which forms a head, is located on the dial side of a bottom plate 7. A bar 8 guides the other end of barrel arbour 3 and covers barrel 1.

In a particular embodiment, at least the first arbour stopping surface 32 or the second arbour stopping surface 33 is made on a component that can be removed from said barrel arbour 3. Economically, at least the first arbour stopping surface 32 or the second arbour stopping surface 33 is formed by a circlip 35 or a key, or a washer which is driven in or bonded or similarly secured, cooperating with a groove 36 or a housing comprised in barrel arbour 3, as in the variant illustrated in FIG. 1. This key or circlip guarantees the shock resistance of the assembly, and in particular absorbs the inertia of the barrel assembly, thus avoiding any damage to movement 100 in which said barrel 1 is mounted.

In order to make it easier to automate the assembly of a ratchet, core 5 advantageously includes a means 54 of axially supporting and centring a ratchet 9, and a means 55 of pivotally driving the ratchet 9.

Preferably, ratchet 9 is driven onto or fixed to core 5.

Figure 3:
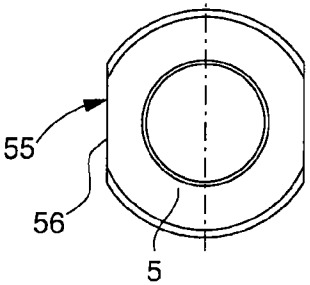
FIG. 3 shows an end view of one end of a core of this type for receiving and driving a ratchet.
Figure 4:
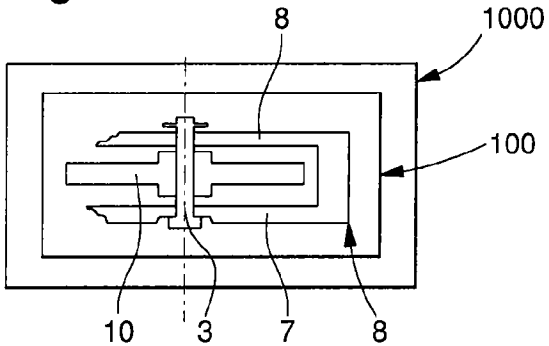
FIG. 4 shows, in the form of block diagrams, a timepiece incorporating a timepiece movement incorporating a barrel of this type.

In a particular and economical variant, as seen in FIG. 3, means 55 of pivotally driving ratchet 9 includes at least one flat drive portion 56. Means 55 may also be formed of two flat portions, a square or any other polygon, or even simply result from a laser weld, bonding or similar. Preferably, when ratchet 9 is removably mounted, the play between means 55 of pivotally driving ratchet 9 and said ratchet is minimal, a slightly clamped assembly is preferably chosen, so as to ensure that the ratchet is properly concentric, to prevent any interference with the gear train.

The barrel according to the invention has a play between the ratchet 9 and drum 2, the axial travel of core 5 is limited, on the one hand by the surface 51 of the core cooperating with the inner surface 22 of drum 2 and, on the other hand, the end surface 52 of rivet seam 57 cooperating with a local top surface 74 of bottom plate 7.

Likewise, it is preferable to limit the play between shoulder 31 of barrel 3 and core bore 53, and between shoulder 31 of barrel arbour 3 and bore 82 of bar 8 to a strict minimum.

In a variant seen in FIG. 1, ratchet 9 has a means of spacing 91 with respect to an inner surface 81 of an element 8, such as a bar, of a structure 6 receiving barrel 1. In a variant also seen in FIG. 1, this bar 8 carries spacing means 85.

In a variant which is not illustrated in the Figures, the barrel arbour 3 is permanently fixed to the bar, by welding or a similar method.

Yet another variant consists in heading, or riveting, or suchlike, the end of barrel arbour 3 projecting from the side of bar 8, so as to avoid the use of an additional component.

Preferably, the invention is applied to a barrel 1 which is a going barrel or a striking work barrel, for a timepiece such as a watch.

The invention also concerns a timepiece movement 100 incorporating at least one barrel 1 of this type.

This movement 100 has a structure 6 with at least one first wall 7 such as a bottom plate, and a second wall 8, such as a bar, together delimiting a chamber for receiving barrel 1, and each including a bore 72, 82 coaxial to the other for receiving and pivotally guiding barrel arbour 3. The first wall 7 has a first complementary arbour stopping surface 73 arranged to form an axial travel limit, particular in the event of a shock, of the first arbour stopping surface 32, and the second wall 8 includes a second complementary arbour stopping surface 83 to form an axial travel limit of the second arbour stopping surface 33, to limit together the axial travel, in pivoting direction D, of arbour 3 relative to structure 6.

In a particular embodiment, seen in FIG. 1, opposite the first complementary arbour stopping surface 73, the first wall 7 has a first inner axial travel limiting surface 74 for limiting the axial travel, in pivoting direction D, of core 5 and/or drum 2 relative to structure 6. This first inner axial travel limiting surface 74 limits the axial travel, in pivoting direction D, of core 5 via cooperation with the second core stopping surface 52.

However, preferably, this surface 74 is sized such that a functional play remains. Preferably, the contact limitation occurs mainly by the cooperation of a fillet 24 comprised in drum 2 with an antagonistic surface 75 of bottom plate 7: due to the small surface area of fillet 24, friction is reduced. The same arrangement is seen on the opposite side between a fillet 91 of ratchet 9 and an antagonistic inner surface 81 of bar 8.

In a particular embodiment, seen in FIG. 1, the second wall 8 includes, opposite the second complementary arbour stopping surface 83, a second inner axial travel limiting surface 84 for limiting the axial travel, in pivoting direction D, of core 5 and/or ratchet 9 relative to structure 6. In a particular embodiment, seen in FIG. 1, the second inner axial travel limiting surface 84 includes a means of spacing 85 with respect to ratchet 9, so as to prevent a large surface of ratchet 9, which forms the cover, from rubbing on a large surface of bar 8.

The invention also concerns a timepiece 1000 incorporating at least one such movement 100, or at least one such barrel 1.

The invention also concerns a method of mounting a timepiece barrel 1 in a receiving structure 6. According to the method, the following are used:

a barrel 1 including:

a drum 2 coaxial to a barrel arbour 3 in a pivoting direction D, said drum 2 being arranged to confine at least one barrel spring 4, a first end 41 of which is fixed or hooked to said drum 2 and a second end 42 of which is fixed or hooked to a core 5, which is coaxial to said barrel arbour 3 and guided on said barrel arbour 3, barrel arbour 3 being removable and including a shoulder 31 arranged to cooperate with a bore 53 of core 5 and further including a first arbour stopping surface 32 and a second arbour stopping surface 33, which face each other and are arranged to limit together the axial travel of barrel arbour 3 relative to structure 6 in the pivoting direction D, core 5 being pivotally guided in a bore 21 comprised in drum 2, and including a first core limiting surface 51, which is arranged to limit the axial travel, in pivoting direction D, of core 5 relative to an inner face 22 of drum 2, and a second core stopping surface 52, which is opposite first core limiting surface 51 and arranged to limit the axial travel, in pivoting direction D, of core 5 relative to an outer face 23 of drum 2, and core 5 including a means of axially supporting and centering a ratchet 9, and a means 55 of pivotally driving ratchet 9, one structure 6 including at least one first wall 7 and one second wall 8 together delimiting a chamber for receiving barrel 1, and first wall 7 and second wall 8 each including a bore 72, 82, coaxial to the other, for receiving and pivotally guiding barrel arbour 3, first wall 7 including a first complementary arbour stopping surface 73 to form an axial travel limit for first arbour stopping surface 32, and second wall 8 including a complementary arbour stopping surface 83 to form an axial travel limit for second arbour stopping surface 33, to limit together the axial travel, in pivoting direction D, of barrel arbour 3 relative to structure 6.

According to the invention, the following steps are performed in succession:

ore 5 is inserted into drum 2 so that said drum is arranged, on the one hand, imprisoned between first core limiting surface 51 and second core stopping surface 52, and on the other hand to pivot freely about core 5, by immobilising first core limiting surface 51 and second core limiting surface 52 relative to core 5 and, in order to achieve this, one end of core 5 is deformed in the shape of a rivet seam 57, or a radially projecting component forming a stop is added to said end. In the advantageous embodiment where at least first core limiting surface 51 or second core stopping surface 52 is formed by a rivet seam 57, said surface is thus made after drum 2 is fitted onto core 5;

the at least one barrel spring 4 is inserted into drum 2, and first end 41 is fixed or hooked to drum 2, and second end 42 is fixed or hooked to core 5;

a ratchet 9 is immobilised on axial supporting and centring means 54 and means 55 of pivotally driving the ratchet 9 comprised in core 5;

a sub-assembly 10 formed by barrel drum 2, said barrel spring, core 5 and ratchet 9 is inserted between first wall 7 and second wall 8 of structure 6, and bore 53 of core 5 is positioned in alignment with coaxial bores 72 and 82 of structure 6;

barrel arbour 3 is passed from one of the sides of structure 6, through one of the walls 7, 8 of structure 6, through core 5, then through the other of the walls 7, 8 of structure 6, barrel arbour 3 is then immobilised by fixing first arbour stopping surface 32 and second arbour stopping surface 33 thereto.

Preferably, this method is implemented by a robotic manipulator. Owing to the very simple design of the invention, only assembling movements parallel to the pivoting direction D are required in order to carry out the assembly.

This design, involving the pre-assembly of the drum and core, then assembly of the barrel spring, then driving the ratchet onto the core, allows easier assembly compared to a conventional assembly where the ratchet is often pre-mounted on the core.

Sub-assembly 10 can be stored pre-assembled, and function checked. It is sufficient simply to set the sub-assembly in position in its movement, to immobilise it via the barrel arbour, and stop the latter longitudinally simply using a circlip or key, to ensure a precise, inexpensive and very shock resistant assembly.

The barrel remains removable once the movement has been completely assembled.

What is claimed is:

1. A timepiece barrel including a pivoting drum and comprising a toothing, coaxial to a barrel arbour in a direction of pivoting, said drum being arranged to confine at least one barrel spring, a first end of which is fixed or hooked to said drum or cooperates with said drum, and a second end of which is fixed or hooked to a core, which is coaxial to said barrel arbour and guided on said barrel arbour, said core being pivotally guided in a bore comprised in said drum, and including a first core limiting surface arranged to limit the axial travel of said core, in said pivoting direction, relative to an inner surface of said drum, and a second core stopping surface opposite said first core limiting surface and arranged to limit the axial travel of said core, in said pivoting direction, relative to an outer surface of said drum, said drum being arranged, on the one hand, imprisoned between said first core limiting surface and said second core stopping surface, which are in opposition to each other, and on the other hand, to pivot freely about said core, wherein said first core limiting surface and/or said second core stopping surface is formed by a rivet seam which projects radially relative to said bore of said drum.

2. The barrel according to claim 1, wherein said second core stopping surface is arranged to cooperate in abutment with a surface of a structure carrying said barrel arbour.

3. The barrel according to claim 1, wherein said first core limiting surface and/or said second core stopping surface is formed by a component, which is coaxial to said core, driven onto or fixed to said core and projects radially relative to said bore of said drum.

4. The barrel according to claim 1, wherein said barrel arbour is removable and includes a shoulder arranged to cooperate in guidance in a bore of said core and further includes a first arbour stopping surface and a second arbour stopping surface, which are opposite each other and are arranged to limit together the axial travel of said barrel arbour, in said pivoting direction, relative to a structure for receiving said barrel.

5. The barrel according to claim 4, wherein at least said first arbour stopping surface or said second arbour stopping surface is made in a single-piece with said barrel arbour in the form of a collar which projects radially relative to said shoulder.

6. The barrel according to claim 5, wherein at least said first arbour stopping surface or said second arbour stopping surface is formed by a circlip or a key cooperating with a groove or a housing comprised in said barrel arbour.

7. The barrel according to claim 4, wherein at least said first arbour stopping surface or said second arbour stopping surface is made on a component that can be removed from said barrel arbour.

8. The barrel according to claim 1, wherein said core includes a means of axially supporting and centring a ratchet, and a means of pivotally driving said ratchet.

9. The barrel according to claim 8, wherein said means of pivotally driving said ratchet includes at least one flat driving portion.

10. The barrel according to claim 8, wherein said ratchet is driven onto or fixed to said core.

11. The barrel according to claim 8, wherein said ratchet includes a means of spacing with respect to an internal surface of a structure for receiving said barrel.

12. The barrel according to claim 1, wherein said barrel is a going barrel or a striking work barrel.

13. The timepiece movement incorporating at least one barrel according to claim 1, wherein said movement includes a structure with at least one first wall and one second wall together delimiting a chamber for receiving said barrel, and each including a bore coaxial to the other for receiving and pivotally guiding said barrel arbour, and wherein said first wall includes a first inner axial travel limiting surface for limiting the axial travel of said core, in said pivoting direction, via cooperation with said second core stopping surface.

14. The movement according to claim 13, wherein said barrel arbour further includes a first arbour stopping surface and a second arbour stopping surface facing each other and arranged to limit together the axial travel of said barrel arbour, in said pivoting direction, relative to a structure for receiving said barrel, said first wall including a first complementary arbour stopping surface which is opposite the first inner axial travel limiting surface and arranged to form an axial travel limit for said first arbour stopping surface, and said second wall including a second complementary arbour stopping surface to form an axial travel limit for said second arbour stopping surface, to limit together the axial travel of said arbour, in said pivoting direction, relative to said structure.

15. The movement according to claim 13, wherein said drum includes a fillet arranged to limit the axial travel in relation with an antagonistic surface comprised in said first wall, to limit the axial travel of said core and/or said drum, in said pivoting direction, relative to said structure.

16. The movement according to claim 14, wherein, opposite said second complementary arbour stopping surface, said second wall includes a second inner axial travel limiting surface for limiting the axial travel of said core and/or a ratchet, in said pivoting direction, relative to said structure.

17. The movement according to claim 16, wherein said second inner axial travel limiting surface includes a means of spacing with respect to said ratchet.

18. The timepiece including at least one movement according to claim 13, or at least one barrel according to claim 1.

19. The method of assembling a timepiece barrel in a receiving structure, wherein the following are used:

one said barrel including:

a drum coaxial to a barrel arbour in a pivoting direction, said drum being arranged to confine at least one barrel spring, a first end of which is fixed or hooked to said drum and a second end of which is fixed or hooked to a core, which is coaxial to said barrel arbour and guided on said barrel arbour, said barrel arbour being removable and including a shoulder arranged to cooperate with a bore of said core and further including a first arbour stopping surface and a second arbour stopping surface, which face each other and are arranged to limit together the axial travel of said barrel arbour, in said pivoting direction, relative to said structure, said core being pivotally guided in a bore comprised in said drum, and including a first core limiting surface, which is arranged to limit the axial travel of said core in said pivoting direction, relative to an inner face of said drum, and a second core stopping surface, which is opposite said first core limiting surface and arranged to limit the axial travel of said core, in said pivoting direction, relative to an outer face of said drum, and said core including a means of axially supporting and centring a ratchet, and a means of pivotally driving said ratchet, one said structure including at least one first wall and one second wall together delimiting a chamber for receiving said barrel, and said first wall and said second wall each including a bore, coaxial to the other, for receiving and pivotally guiding said barrel arbour, said first wall including a first complementary arbour stopping surface to form an axial travel limit for said first arbour stopping surface, and said second wall including a second complementary arbour stopping surface to form an axial travel limit for said second arbour stopping surface, to limit together the axial travel of said barrel arbour in said pivoting direction, relative to said structure, further wherein the following steps are performed in succession:

said core is inserted into said drum so that said drum is arranged, on the one hand, imprisoned between said first core limiting surface and said second core stopping surface, and on the other hand to pivot freely about said core, by immobilising said first core limiting surface and said second core stopping surface relative to said core and, in order to do so, one end of said core is deformed in the shape of a rivet seam;

said at least one barrel spring is inserted into said drum, and said first end is fixed or hooked to said drum, and said second end is fixed or hooked to said core;

a ratchet is immobilised on said axial supporting and centring means and said means of pivotally driving said ratchet comprised in said core;

said sub-assembly formed by said barrel drum, said barrel spring, said core and said ratchet is inserted between said first wall and said second wall of said structure, and said bore of said core is positioned in alignment with said coaxial bores of said structure;

said barrel arbour is passed from one of the sides of said structure through one of said walls of said structure, though said core, then through the other of said walls of said structure, said barrel arbour is then immobilised by fixing said first arbour stopping surface and said second arbour stopping surface thereto.

* * * * *